US008286684B2

(12) United States Patent
Hanley et al.

(10) Patent No.: US 8,286,684 B2
(45) Date of Patent: Oct. 16, 2012

(54) HANDLE WITH ANTI-ROTATION MECHANISM FOR A WINDOW TREATMENT

(75) Inventors: Michael P. Hanley, Smithfield, RI (US); Carolyn M. Martin, Providence, RI (US); Robert A. Garde, Johnston, RI (US)

(73) Assignee: Kenney Manufacturing Company, Warwick, RI (US)

( * ) Notice: Subject to any disclaimer, the term of this patent is extended or adjusted under 35 U.S.C. 154(b) by 0 days.

(21) Appl. No.: 12/829,834

(22) Filed: Jul. 2, 2010

(65) Prior Publication Data

US 2010/0269984 A1 Oct. 28, 2010

Related U.S. Application Data

(63) Continuation-in-part of application No. 29/363,069, filed on Jun. 4, 2010, now Pat. No. Des. 637,856.

(60) Provisional application No. 61/223,914, filed on Jul. 8, 2009, provisional application No. 61/332,349, filed on May 7, 2010, provisional application No. 61/332,354, filed on May 7, 2010, provisional application No. 61/348,413, filed on May 26, 2010.

(51) Int. Cl.
*A47H 5/00* (2006.01)

(52) U.S. Cl. ..... 160/84.04; 16/421; 294/209

(58) Field of Classification Search ..... 160/84.04, 160/177 R, 177 V, 241, 905, 906, 911, 912, 160/913, 405; 294/209, 210, 211; 16/422, 16/426, 427, 429, 421

See application file for complete search history.

(56) References Cited

U.S. PATENT DOCUMENTS

| | | | | |
|---|---|---|---|---|
| 610,020 | A * | 8/1898 | Bergeron | 160/74 |
| 895,200 | A * | 8/1908 | Roe | 160/72 |
| 924,951 | A * | 6/1909 | Winberg | 160/70 |
| 1,712,455 | A * | 5/1929 | Connolly | 160/309 |
| 3,389,738 | A * | 6/1968 | Roth | 160/120 |
| 4,715,089 | A * | 12/1987 | Schema | 16/429 |
| 5,791,805 | A * | 8/1998 | Lynch et al. | 403/374.1 |
| 6,199,245 | B1 * | 3/2001 | Blessing | 16/430 |
| 7,185,691 | B2 * | 3/2007 | Toti | 160/173 R |
| 7,204,292 | B2 * | 4/2007 | Nien | 160/168.1 R |
| 2002/0062931 | A1 * | 5/2002 | Allsopp | 160/168.1 R |
| 2004/0103995 | A1 * | 6/2004 | Nien | 160/170 |
| 2004/0200583 | A1 * | 10/2004 | Nien | 160/177 R |

OTHER PUBLICATIONS

PCT/US2010/040937 International Preliminary Report on Patentability, including written opinion: Jan. 10, 2012 (6 pages).

PCT/US2010/040937 International Search Report: Sep. 1, 2010 (2 pages).

* cited by examiner

*Primary Examiner* — David Purol

(74) *Attorney, Agent, or Firm* — C. Nessler

(57) ABSTRACT

A handle assembly for adjusting a window treatment is disclosed. A wand is included and is configured and arranged to adjust a window treatment. The handle includes a grip on the wand, and has at least one engagement surface thereon. Further, the handle includes a cleat having at least one reciprocal mating surface configured and arranged to selectively interlock with the at least one engagement surface of the grip.

12 Claims, 19 Drawing Sheets

HANDLE WITH ANTI-ROTATION MECHANISM FOR A WINDOW TREATMENT

CROSS-REFERENCE TO RELATED APPLICATIONS

The present patent document claims priority to earlier filed U.S. Provisional Patent Application Ser. Nos. 61/223,914, filed on Jul. 8, 2009, 61/332,349, filed on May 7, 2010, 61/332,354, filed on May 7, 2010, 61/348,413, and filed on May 26, 2010, and is a continuation in part of U.S. Design patent application Ser. No. 29/362,812, filed on Jun. 1, 2010, the entire contents of all of which are incorporated herein by reference.

BACKGROUND OF THE INVENTION

1. Field of the Invention

The present patent document relates generally to window treatments and more particularly to a handle with an anti-rotation mechanism for window treatments, such as a cordless roll-up shade.

2. Background of the Related Art

Window treatments having cords to raise and lower the window treatment are well known in the art. However, these prior-art corded window treatments suffer from the disadvantage of exposing children and animals to a potential strangulation hazard. In particular, it is well documented that children or animals can become caught in the cords and be strangled. Various regulations and methods have been adopted to reduce the potential of strangulation to occur, such as using detachable cords and cords that have no continuous loops. However, the potential of strangulation is so great that it is desirable to produce a window treatment that lacks cords entirely, yet can still be mechanically raised and lowered.

Therefore, there is a need in the art for a window treatment that lacks cords to adjust the height of the window treatment.

Also, window treatments that are suspended from brackets that are attached to a window opening (or surrounding wall) of a window are well known in the art. The prior art brackets are often configured to attach to the outside portion of the window opening, which is referred to as an "outside mount", or the inside portion of the window opening, which is referred to as an "inside mount". However, these prior art systems suffer from a couple of disadvantages. Outside mount assemblies necessarily move the window treatment away from the window, which makes the window treatment drafty and less heat efficient. Inside mount assemblies are limited by the width of the window because the window treatment is also within the confines of the window opening, but disadvantageously permit light and draft to exit the sides of the window treatment.

Accordingly, there is a perceived need in the industry for a method of mounting a window treatment in a window opening that permits the window treatment to overlap the sides of the window opening like an outside mount, yet is nearly flush with the window opening like an inside mount.

SUMMARY OF THE INVENTION

The present invention solves the problems of the prior art by providing a cordless roll-up shade that eliminates the use of cords to raise and lower the shade. Specifically, the shade includes a take up member attached to a support assembly that preferably Another provision of the present invention is for a hybrid mounting assembly having a pair of brackets that are mounted on an inside portion of the window opening. A head rail assembly attaches to the brackets and can extend beyond the outside edges of the opening. A window treatment is suspended from the head rail.

An objective of the present invention is the provision for a hybrid mounting assembly to permit a window treatment that is wider than the window to be mounted nearly flush with the window opening.

Another objective of the present invention is the provision for a hybrid mounting assembly that is mounted on the inside portion of the window opening yet permits attachment of a wider window treatment to the mounting assembly.

Yet another objective of the present invention of the provision for a hybrid mounting assembly that includes a head rail that is wider than the window, yet still permits a nearly flush mount of a window treatment to the head rail.

Another provision of the present invention is the inclusion of a handle that includes a cleat to engage the handle, thereby preventing the handle from rotating. The cleat also has the added advantage to preventing the handle from wandering or swinging as well.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
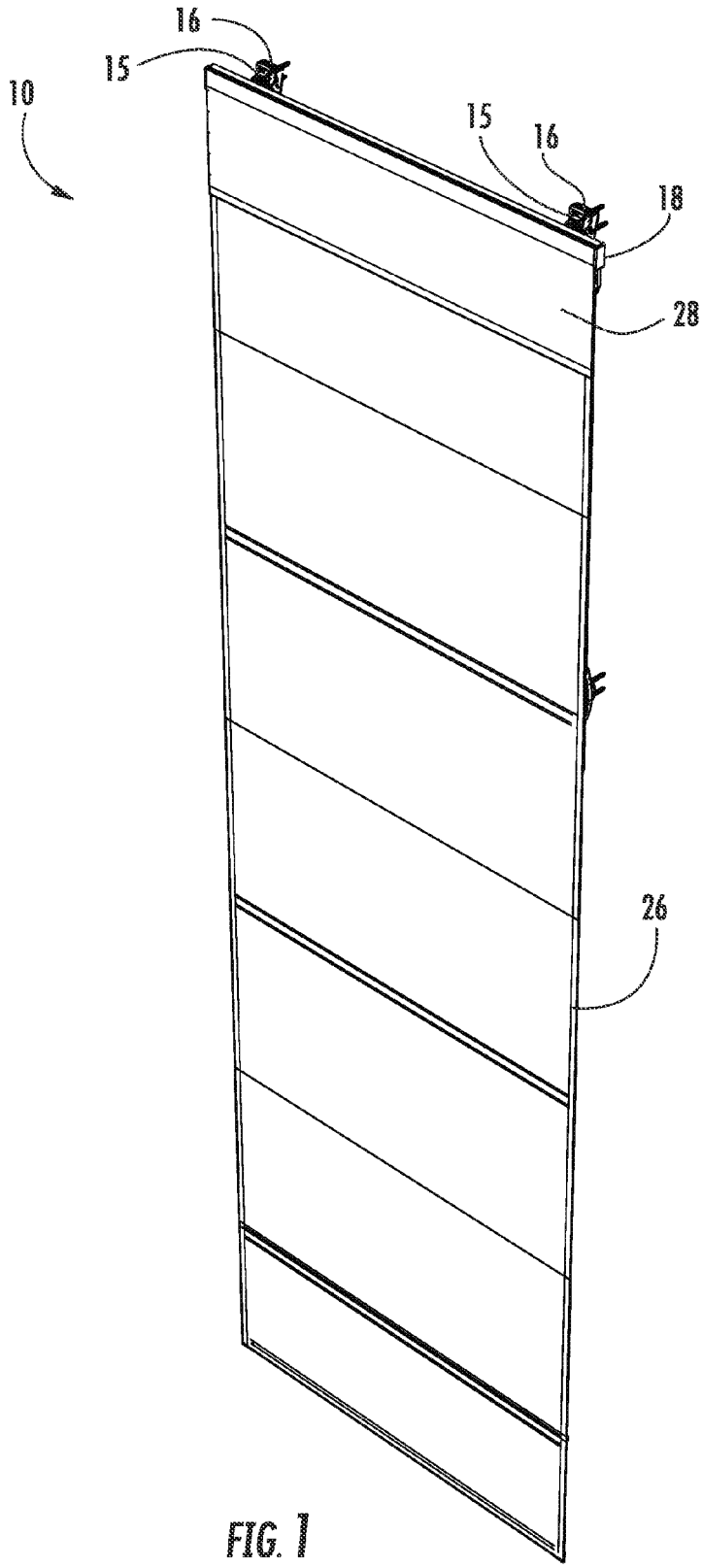
FIG. 1 is a front perspective view of an embodiment of the cordless roll-up shade of the present invention.
Figure 2:
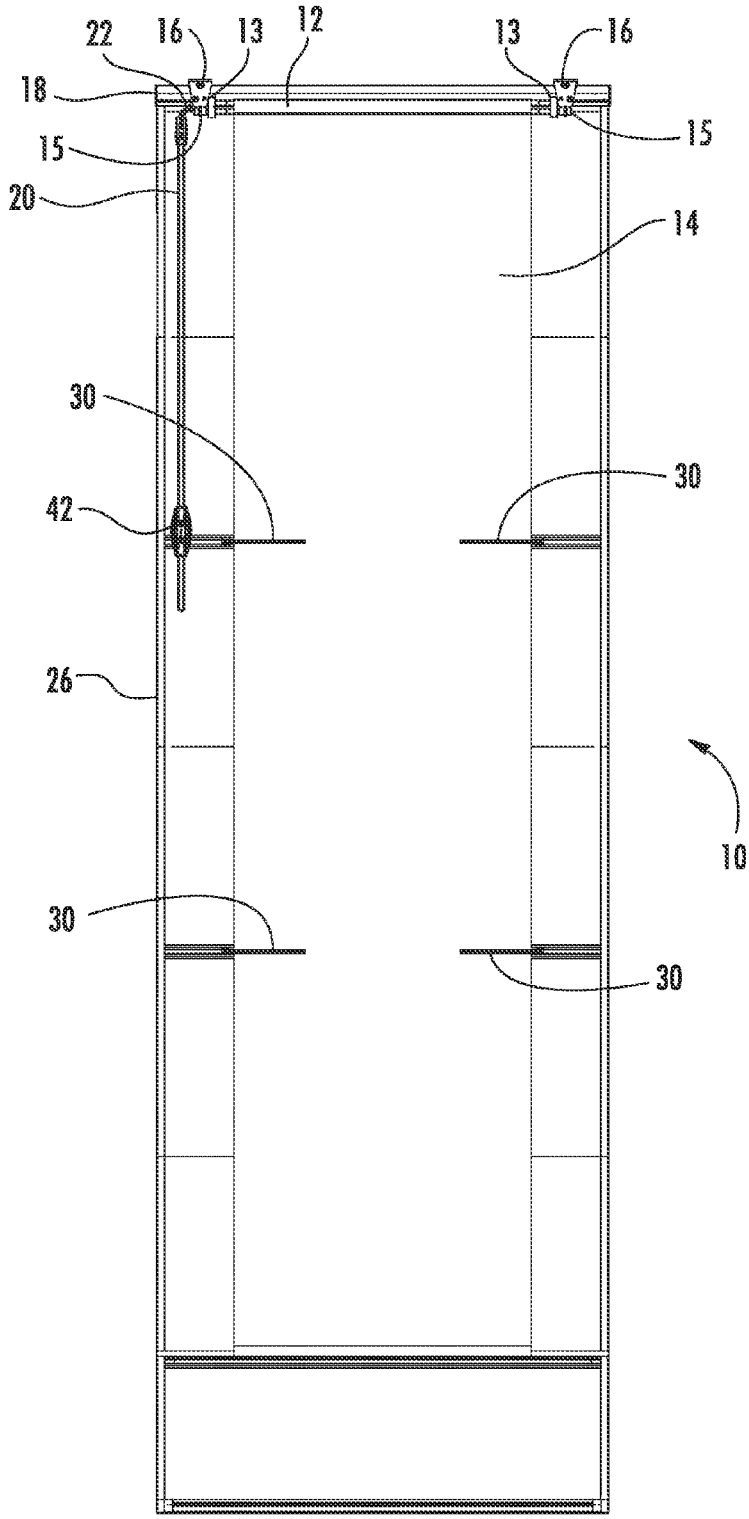
FIG. 2 is a rear view of an embodiment of the cordless roll-up shade of the present invention.
Figure 3:
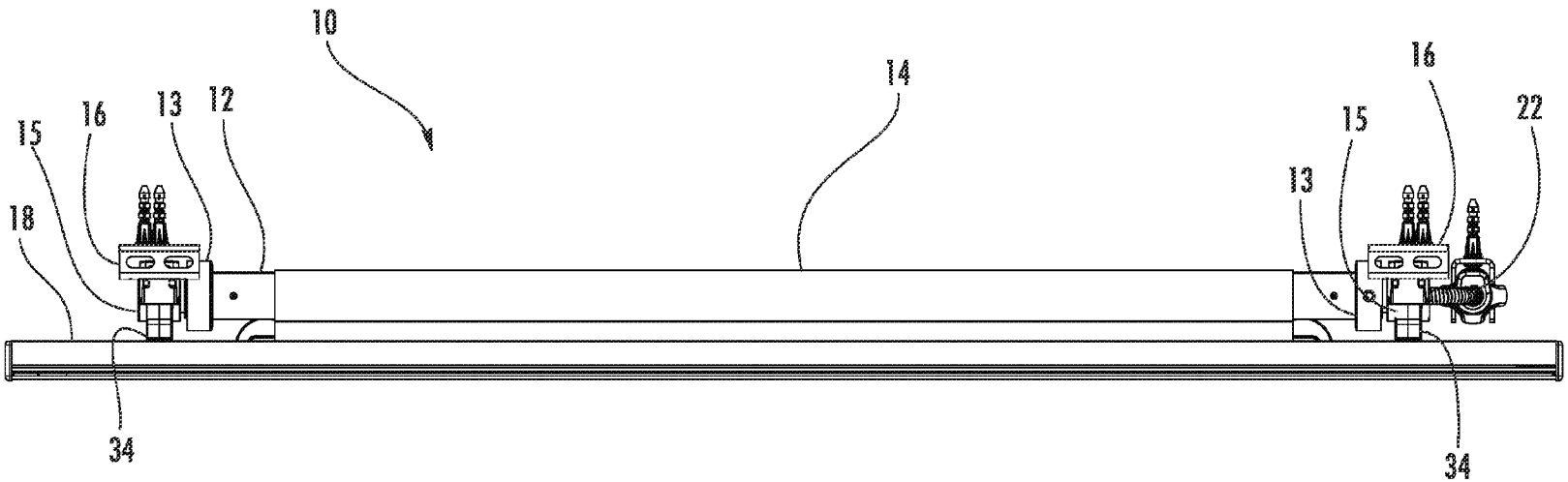
FIG. 3 is a top view of an embodiment of the cordless roll-up shade of the present invention.
Figure 4:
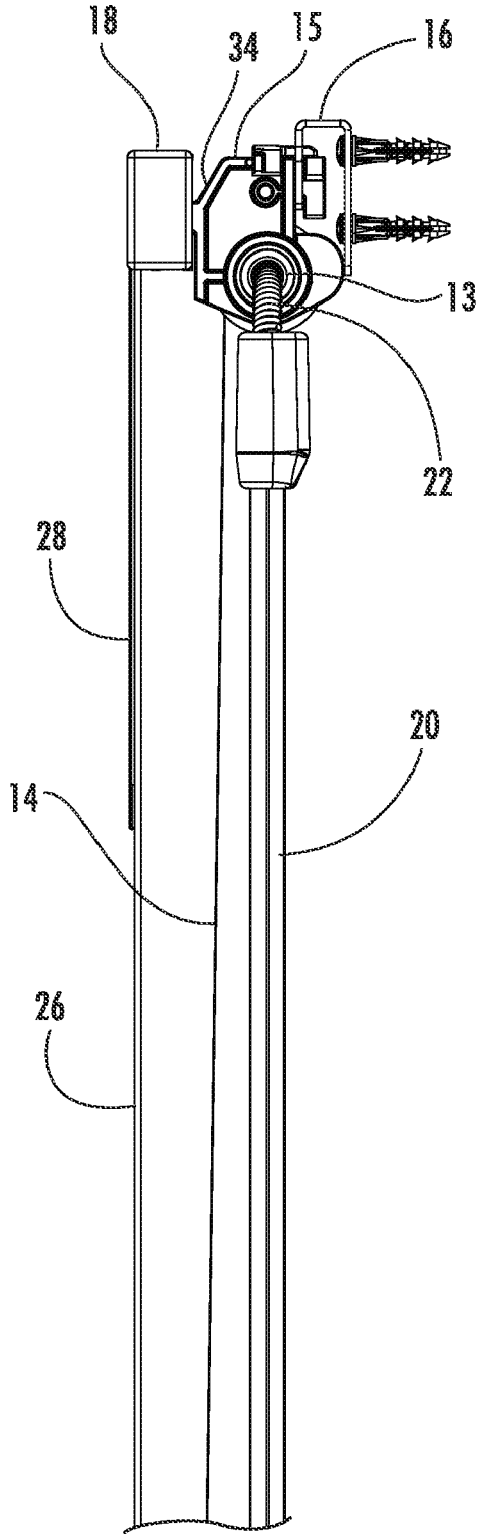
FIG. 4 is a partial side view of an embodiment of the cordless roll-up shade of the present invention.
Figure 5A:
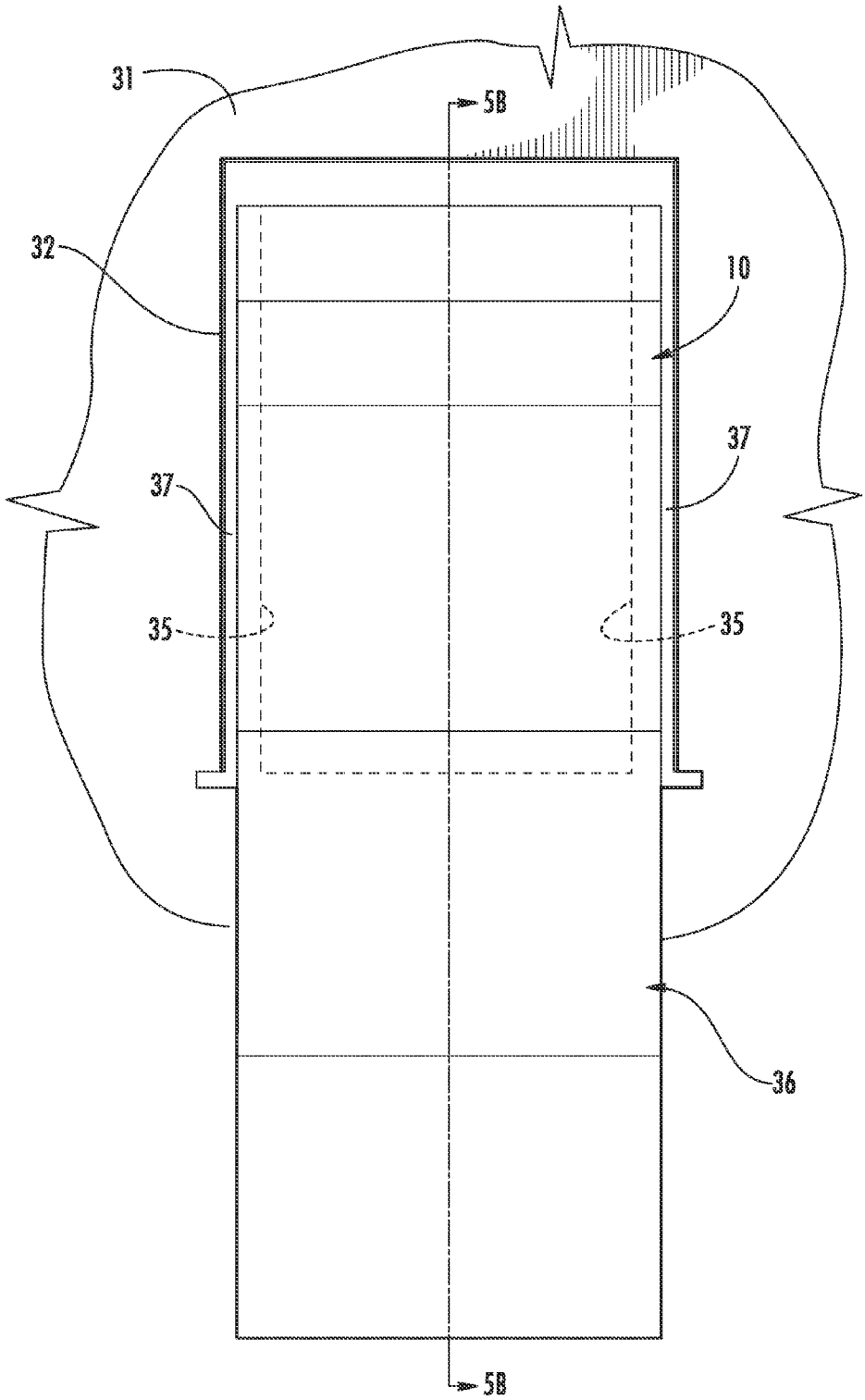
FIG. 5*a* is a front view of an embodiment of the cordless roll-up shade of the present invention mounted within a window opening.
Figure 5B:
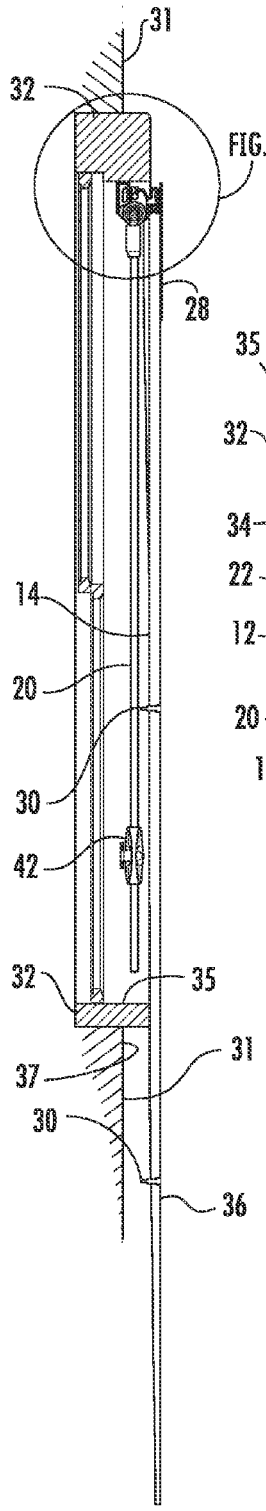
FIG. 5*b* is a side cross-section view through line 5*b*-5*b* of FIG. 5.
Figure 5C:
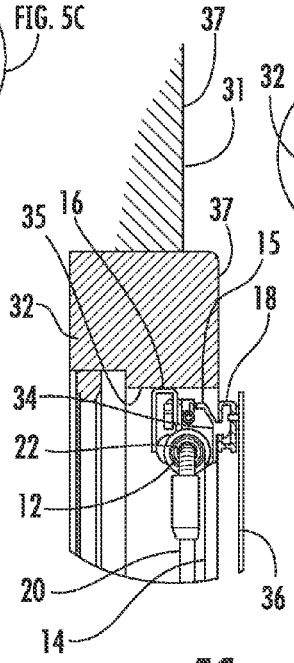
FIG. 5*c* is a close up view of Inset B of FIG. 5*b;*
Figure 5D:
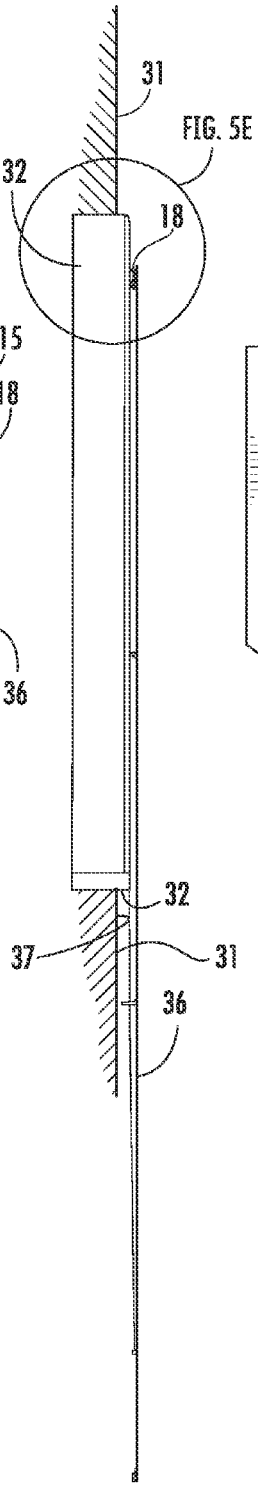
FIG. 5*d* is a side view of an embodiment of the cordless roll-up shade of the present invention mounted within a window opening.
Figure 5E:
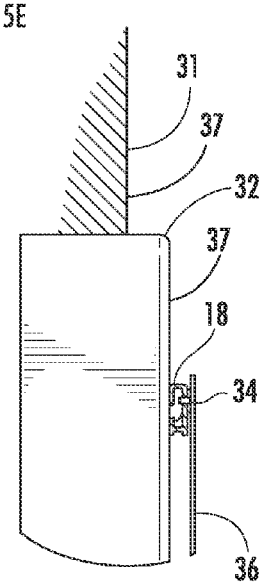
FIG. 5*e* is a close up view of Inset C of FIG. 5*d;*

Referring now to FIGS. 1-4, an embodiment of the cordless roll-up shade of the present invention is shown generally at 10. The cordless roll-up shade includes a take up member, such as a shade rod 12. Wrapped about the shade rod 12 is a back panel 14, or lifting member, which raises the front panel 26 as further described below. The back panel 14 is preferably narrower than the front panel 26, but could be as wide or wider than the front panel 16. The back panel 14 may be made of any light flexible material that can be wound about the shade rod, such as mesh, cloth, fabric, polyester, nylon, polyester mesh, nylon mesh, silk, plastic, vinyl, and combinations and blends thereof. The back panel 14 may also be of different widths provided it is sufficiently wide enough to avoid being a strangulation hazard as cords are prone to being. For example, narrower ribbons of material may be used as the back panel 14.

The shade rod 12 is attached to a support assembly. Specifically, the shade rod 12 may include tube end connectors 13 held in a pair of opposing bearing blocks 15. The shade rod 12 is further configured and arranged to rotate within the bearing blocks 15. The bearing blocks 15 or tube end connectors 13 may have bushings to permit the shade rod 12 to rotate more freely and smoothly. The bearing blocks 15 are supported by a pair of brackets 16. The brackets 16 are configured to be mounted to a wall opening, such as a doorway, window opening (best seen in FIGS. 5*a*-5*e*) or casement with fasteners, such as screws, nails or bolts. The brackets 16 may be configured to mount horizontally, vertically or at another angle to the wall or window opening. Additional spacers and braces may be used to support the brackets 16 against the wall opening. A head rail 18 may also be used to secure the brackets 16 to the window opening 32. The head rail 18 may also be used to secure the front panel 26 to the wall opening or casement.

Figure 8:
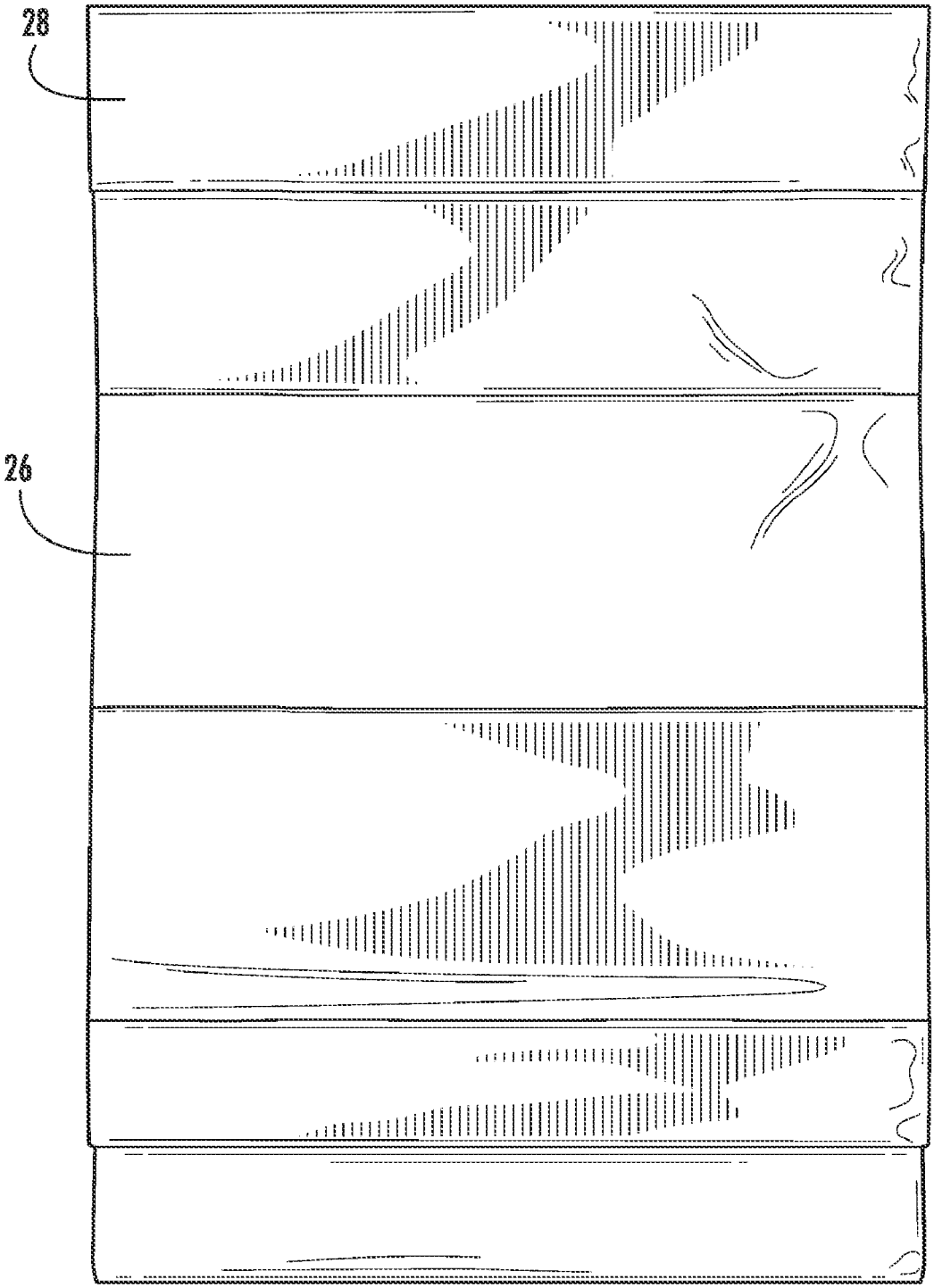
FIG. 8 is a front view of an embodiment of the cordless roll-up shade of the present invention with the decorative front panel partially rolled up.
Figure 9:
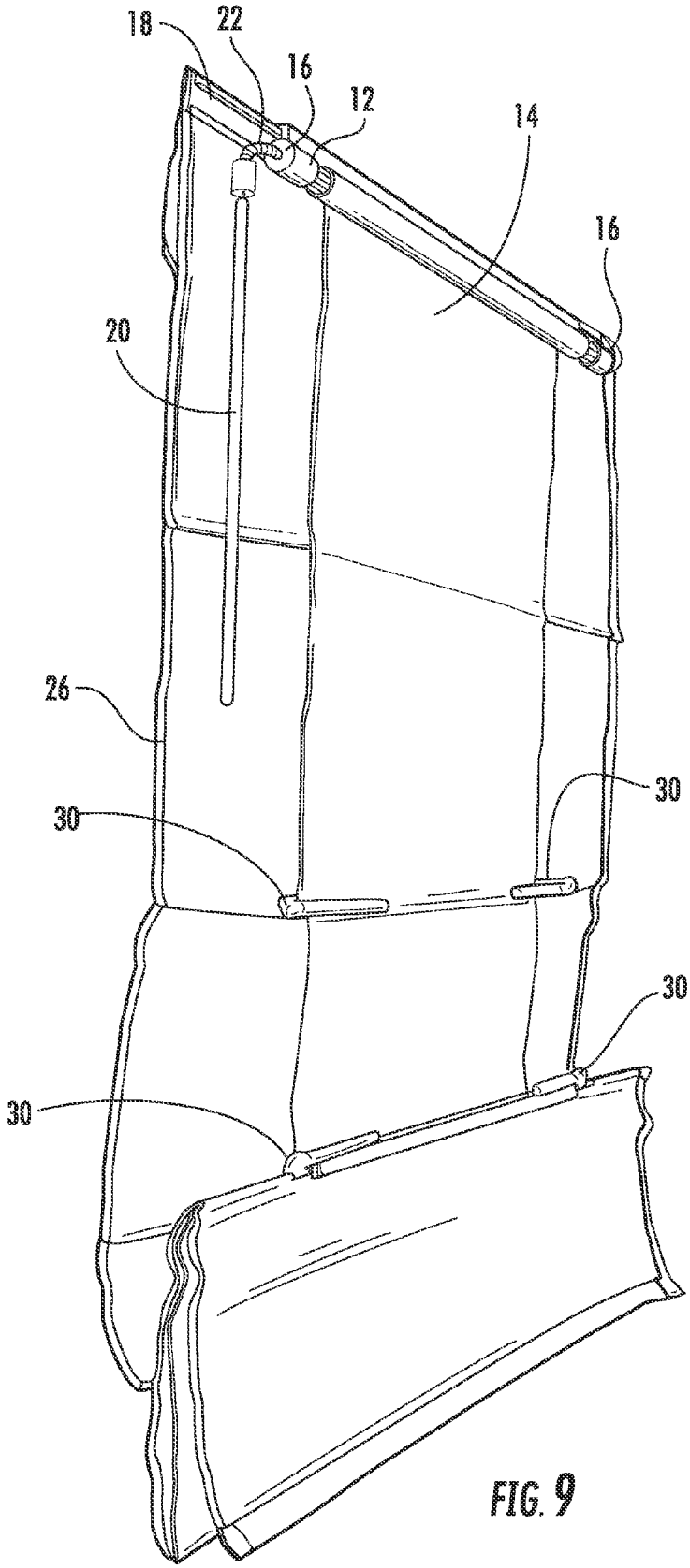
FIG. 9 is a rear perspective view of an embodiment of the cordless roll-up shade of the present invention with the decorative front panel partially rolled up.
Figure 10A:
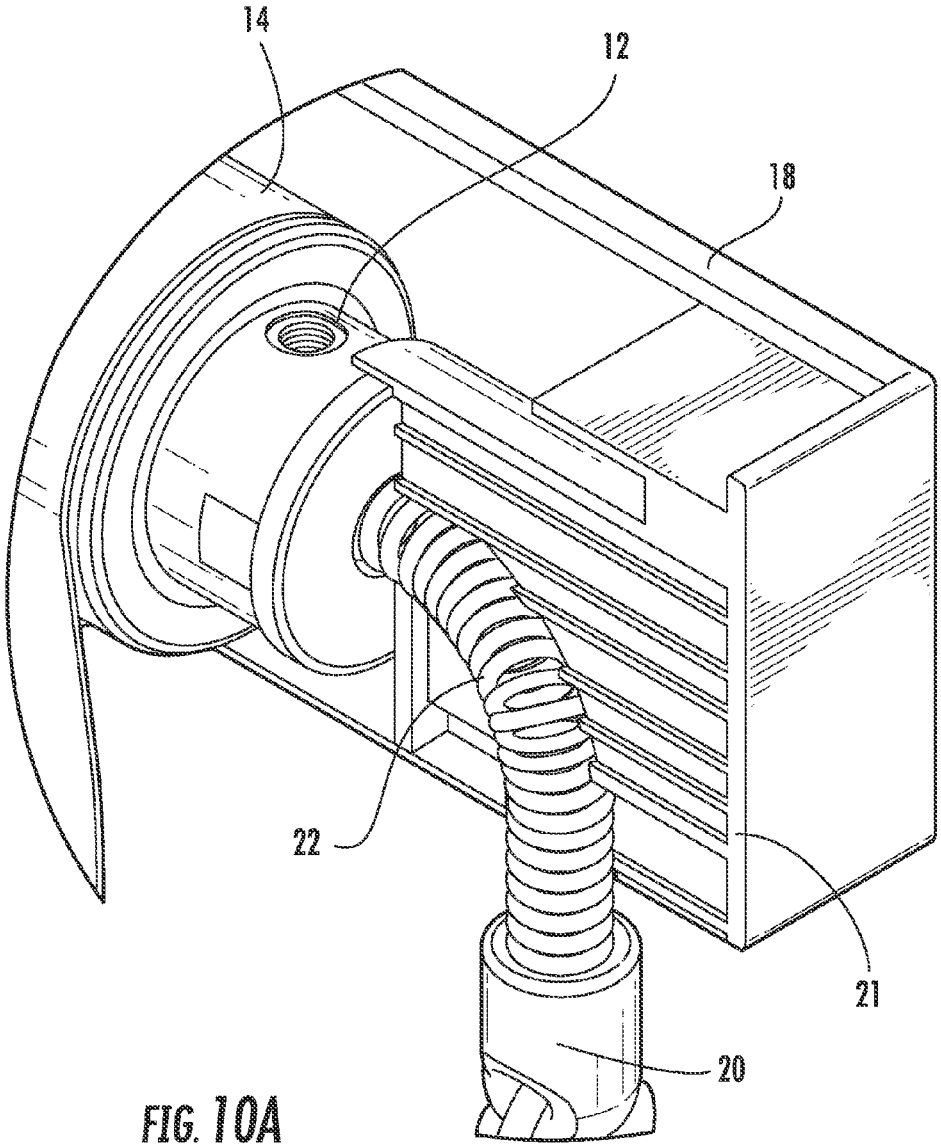
FIG. 10*a* is a partial cross-section view showing a preferred embodiment of a flexible shaft transmission shown with an optional guide block of the cordless roll-up shade of the present invention.

A wand 20 is configured to drive the shade rod 12 through a linkage or transmission. An operator rotates the wand 20 to raise and lower the back panel 14. In one embodiment, a flexible shaft 22 (best seen in FIG. 10*a*), such as a spring or cable is used as a transmission or linkage to connect the wand 20 to the shade rod 12. However, a universal joint would also function as well (as seen in FIG. 10*d* at 24). The flexible shaft 22 translates or links the rotational movement of the wand 20 into rotational movement of the shade rod 12, which in turn raises or lowers the back panel 14 wound about the shade rod 12 as shown in FIGS. 8 and 9. The shade rod 12, back panel 14, wand 20 and flexible shaft 22 (or other transmission 24, 38, 40) form the lifting assembly to raise and lower the decorative front panel 26.

As described further below in the alternative embodiments (shown in FIGS. 10*b*-10*d*), a different type of transmission or gearbox may also be used to translate the rotational movement of the wand 20 into rotational movement of the shade rod 12 also. Additionally, a guide block 21 (best seen in FIG. 10*a*) may be provided to orient the flexible shaft 20 downwards and parallel to the back panel 14 to prevent the wand 20 from wandering.

Referring back now to FIGS. 1 and 3, a decorative front panel 26 may be suspended from the head rail 18. Alternatively the front panel 26 may be suspended from the window opening in front of the shade rod 12 by one or more fasteners. The front panel 26 has a front face and a rear face. In a preferred embodiment, the front panel 26 is in the form of a Roman shade. The front panel 26 may also be formed as a mini-blind or roll-up shade. Additionally, the front panel 26 may also be made of a number of different materials as is known in art, such as cloth, fabric, polyester, nylon, plastic, vinyl, and bamboo. The front panel 26 may also include a privacy liner or blackout liner.

Figure 6:
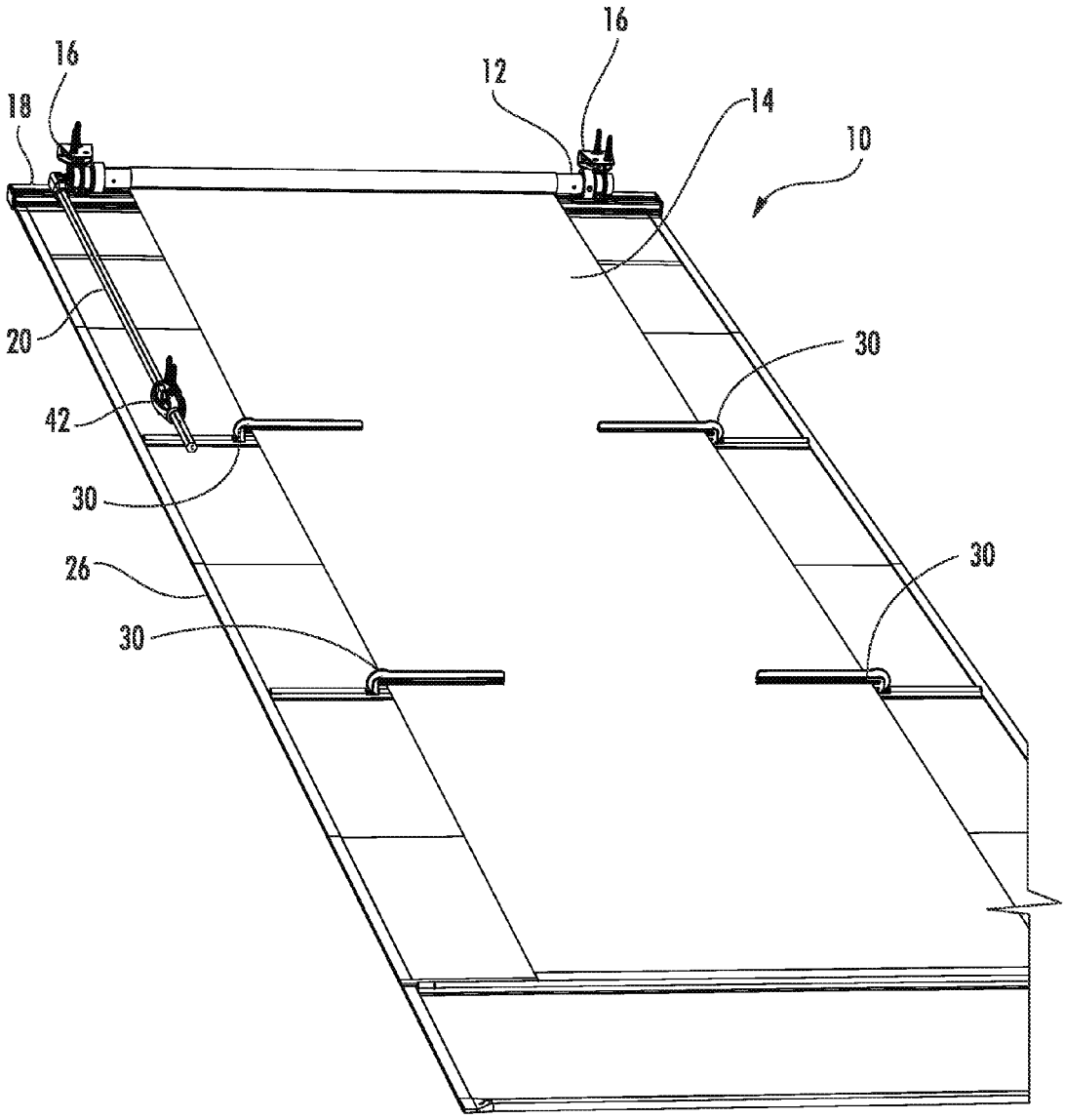
FIG. 6 is a rear perspective view of an embodiment of the cordless roll-up shade of the present invention.
Figure 7:
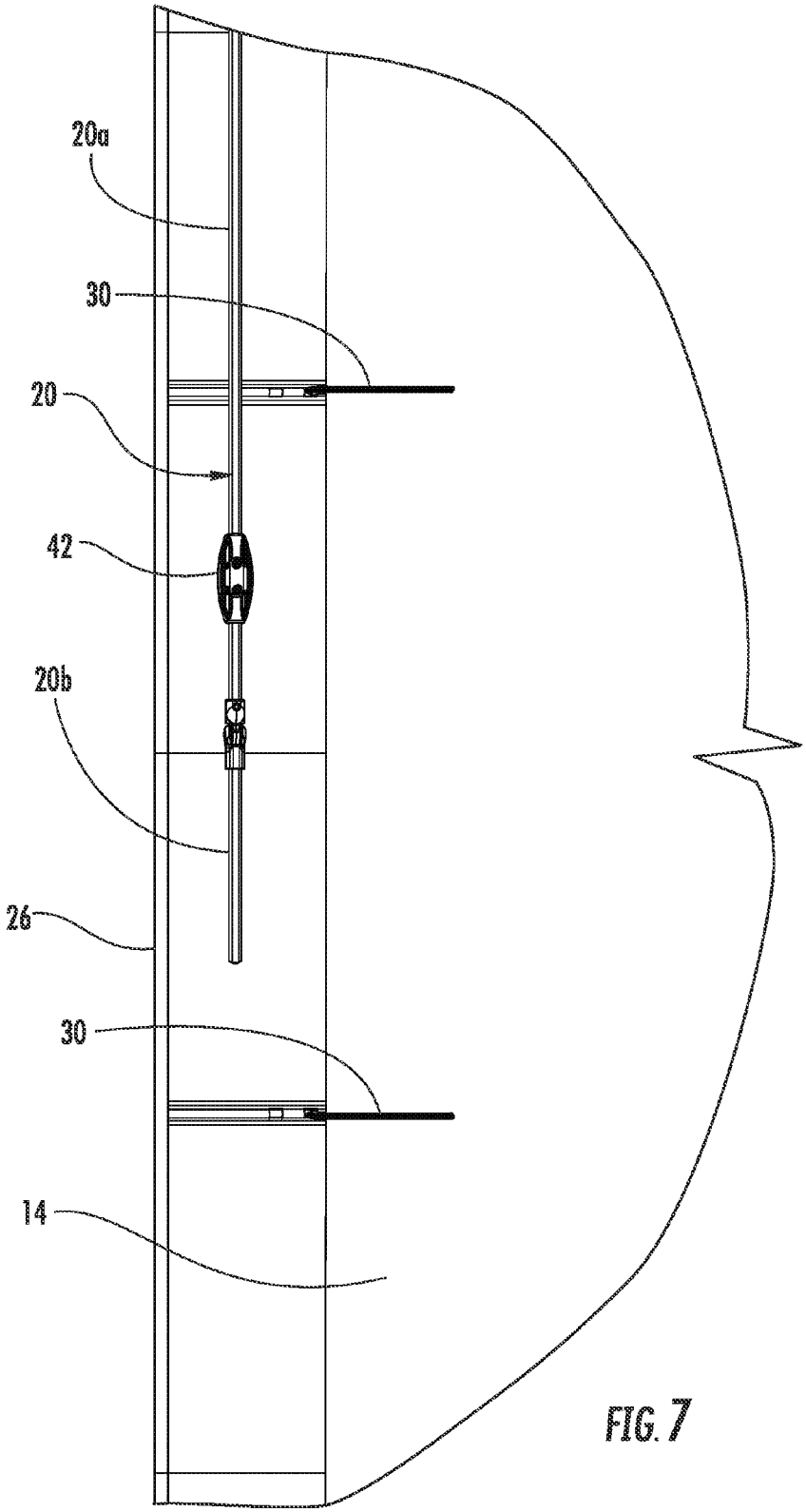
FIG. 7 is a partial rear view of an embodiment of the cordless roll-up shade of the present invention showing the wand.

In the case of a Roman shade, the front panel 26 is formed from a number of sections having a pleat formed between each section. Extending from the rear face of the front panel 36 at each pleat is a pair of inwardly facing hooks or guides 30 that guide the front panel 36 (best seen in FIGS. 6 and 7) along the back panel 14. As the cordless roll-up shade 10 is rolled up, the guides 30 cause folds to be formed in the front panel 26 as shown in FIGS. 8 and 9. The back panel 14 is secured near the bottom 41 of the front panel 26 with fasteners, such as hook and loop or buttons, for instance. Alternatively, the back panel 14 may be anchored to the bottom-most pair of guides 30 on the front panel 26.

The guides 30 may be formed as a unitary wire loop, wire hooks, or a cloth pocket may also be used. Additionally a unitary rod may be used as a guide 30 as well.

A head rail 18 may be used to suspend the shade rod 12 and the front panel 26 to a window opening 32 rather than fastening the brackets 16 directly to the window opening 32. As shown in FIGS. 1-4, however, it is preferable that the head rail 18 is supported by the support assembly in the window opening 32, which permits the use of a hybrid mounting assembly described further below in FIGS. 5*a*-5*e*. Specifically the bearing blocks 15 may include a head rail support member 34, described further below.

The front panel 26 may be suspended from the head rail with fasteners, such as hook and loop or buttons, for instance. The head rail 18 may be fastened to the window opening to suspend the cordless roll-up shade 10 thereto. An optional decorative valence 28 may be included to disguise the head rail 18 and hide the support assembly and lifting assembly.

A ratchet (not shown) may be included on one or both of the bearing blocks 13 to further reduce the risk of the cordless roll-up shade 10 from unfurling once it is rolled up. The ratchet includes a spring-biased plunger, or detent, that engages recesses on the tube end connector 15 to prevent the shade rod 12 from spinning loose freely.

Another aspect of the invention involves how the head rail is positioned relative to the window opening. Referring now to FIGS. 5*a*-5*e*, a preferred embodiment of a hybrid mounting assembly of the present invention supporting a window treatment 36, such as a cordless roll-up shade or the present invention, is shown in a window 32 generally at 10. However, it must be understood that the window treatment 36, may be mounted in another wall 31 opening such as a doorway. Also, the window opening 32 may or may not include a casement. The hybrid mounting assembly 32 includes at least one support assembly, preferably two, such as brackets 16 and bearing blocks 15 described previously, that are mounted to a top of an inside portion 35 of the window opening 32 (or surrounding wall 31).

Extending from the bearing blocks 15 is a head rail support member 34, which supports a head rail 18 that extends across the window and in front of the outside portion 37 of the window opening. The head rail support member 34 extends forward of the inside portion 35 of the window opening a minimal, yet sufficient distance in order to keep the head rail 18 close to the outside portion 37 of the window opening. Furthermore, the depth of the head rail 18 itself is narrow in order to minimize the distance that a window treatment 36 is spaced from the outside portion 37 of the window opening.

As described above, the window treatment 36 is supported by the head rail 18 and hangs down in front of the window. Because the head rail 18 extends wider than the window, an operator can select a window treatment 36 may overlap at least a portion of the sides of the outside portion 37 of the window opening 32, thus blocking light. Because the head rail 18 is narrow and with little projection from the window and because the bearing blocks 15, head rail support member 34 and brackets 16 are mounted to the inside portion 35 of the window opening 32, the window treatment 36 is kept nearly flush to the outside portion 37 of the window opening 32, which minimizes draft and light from the window.

Figure 10B:
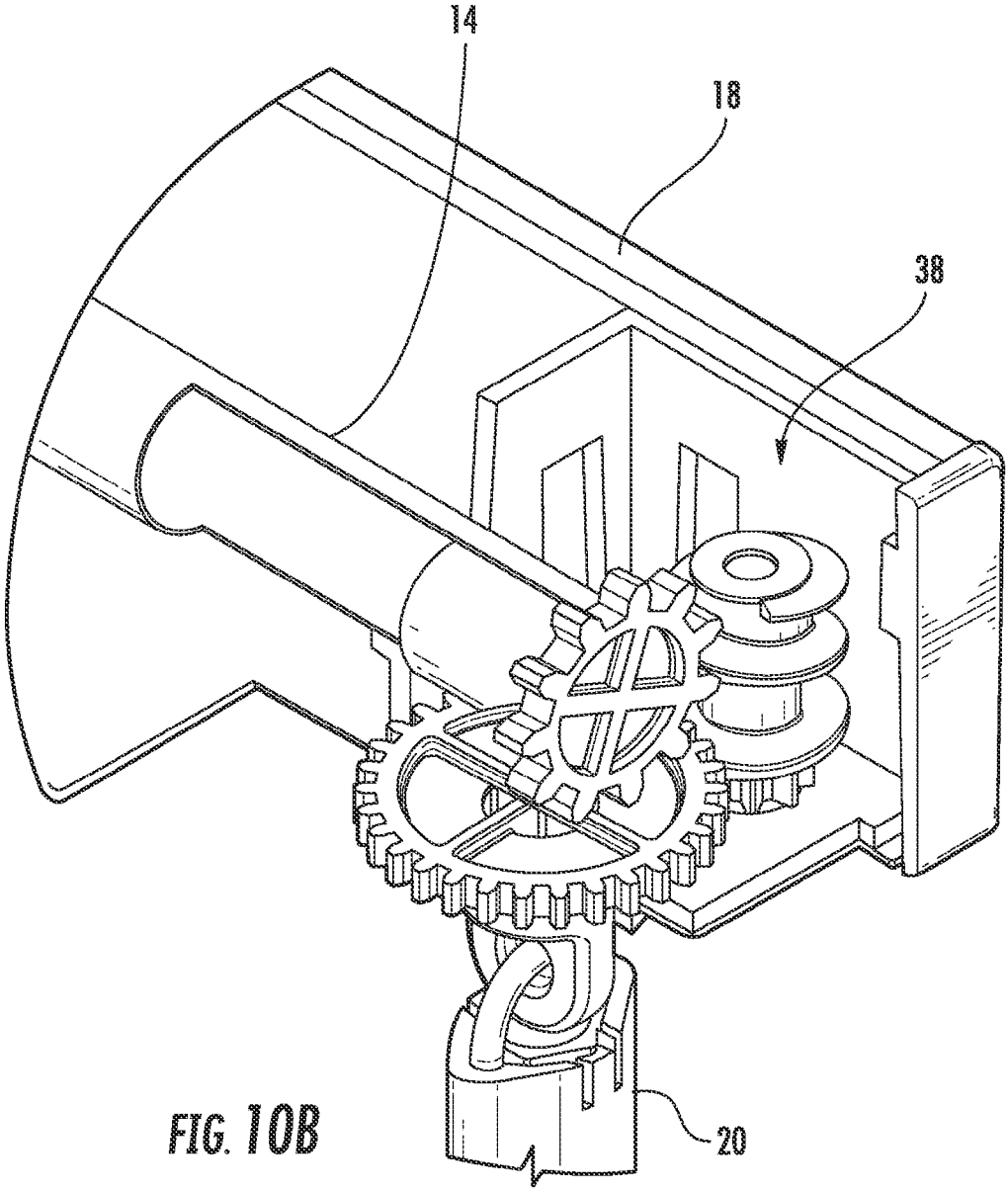
FIG. 10*b* is a partial cross-section view showing an alternative embodiment of a worm gear transmission of the cordless roll-up shade of the present invention.

Referring to FIG. 10*b*, in another embodiment a transmission including a worm gear 38 may be used to translate or communicate the rotational motion of the wand into the shade rod 12. The worm gear 38 has the added advantage of being self-locking, i.e. the cordless roll-up shade 10 will remain up or down in the position it was set by the operator and will resist slipping.

Figure 10C:
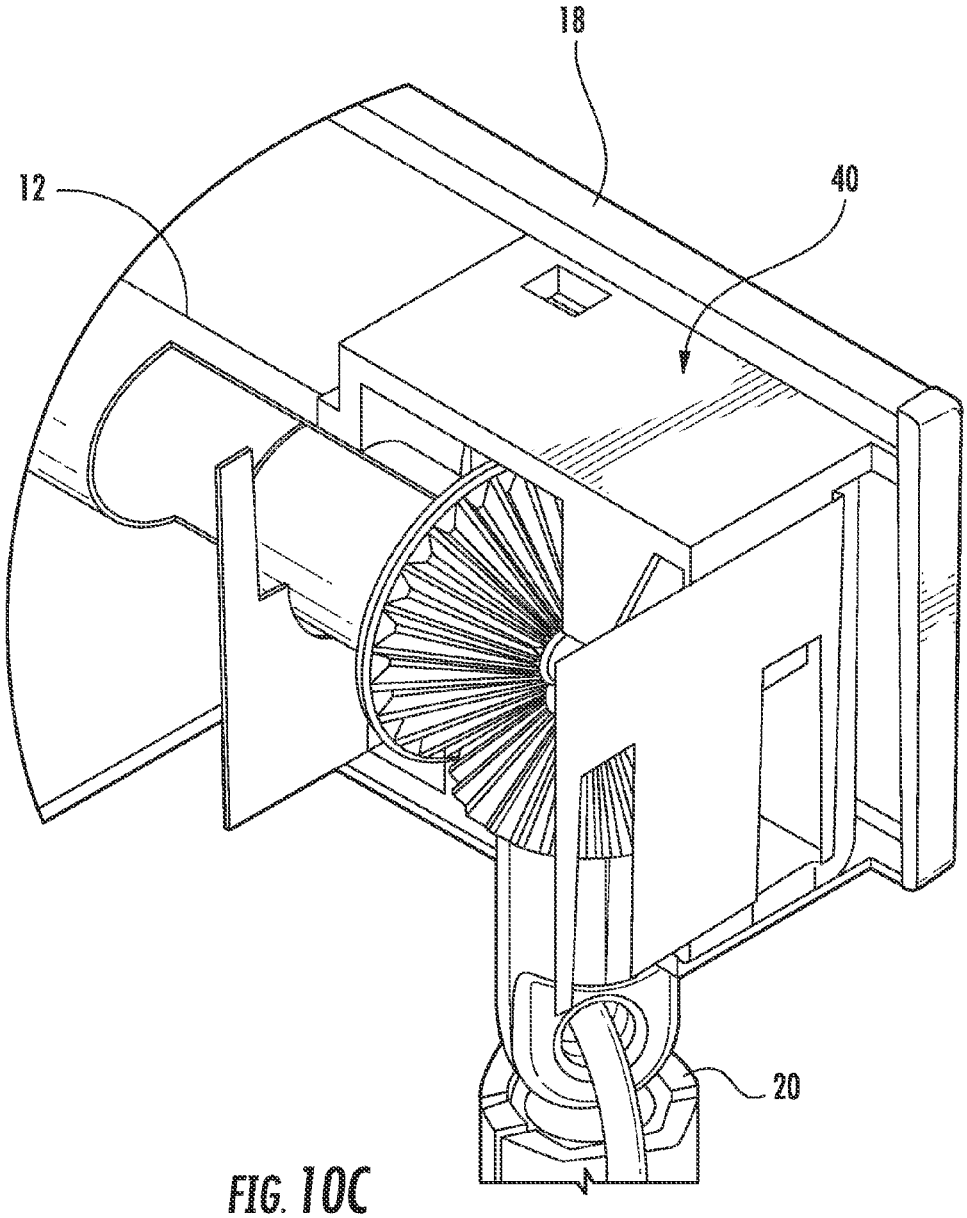
FIG. 10*c* is a partial cross-section view showing an alternative embodiment of a bevel gear transmission of the cordless roll-up shade of the present invention.
Figure 10D:
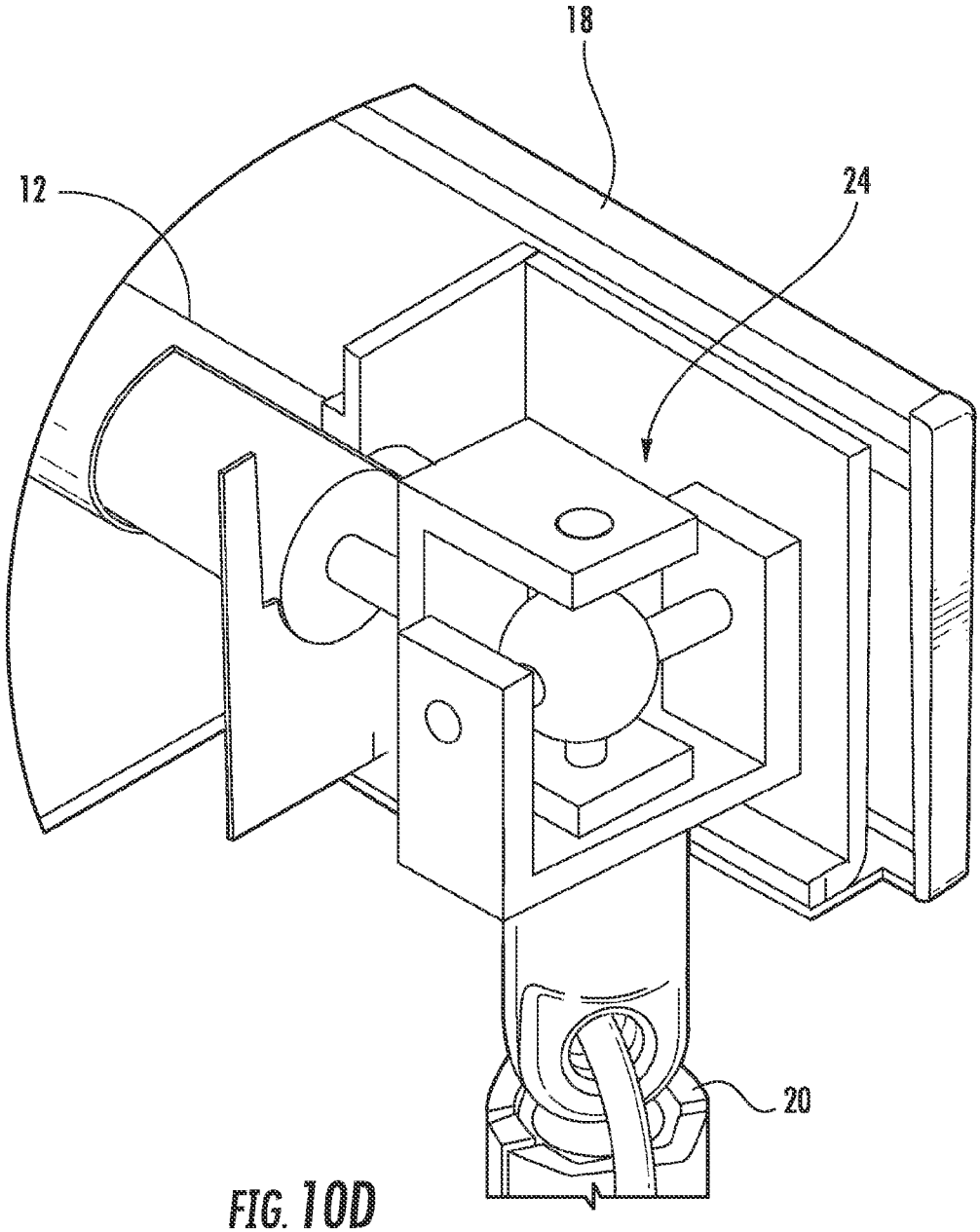
FIG. 10*d* is a partial cross-section view showing an alternative embodiment of a universal joint gear transmission of the cordless roll-up shade of the present invention.

Referring to FIG. 10*c*, in another embodiment a transmission includes a pair of bevel gears 40 may be used to translate or communicate the rotational motion of the wand 20 into the shade rod 12. Although a one-to-one ratio is shown, other ratios of the bevel gears 40 may be selected. The ratios of the bevel gears 40 may be selected as desired to control how fast or slow the back panel 12 may be furled or unfurled by rotating the wand 20.

Referring to FIG. 10*d*, in another embodiment a transmission includes a universal joint 24 which may be used to translate the rotational motion of the wand 20 into the shade rod 12. The universal joint 24 also includes the advantage of being self-locking like the worm gear 38.

Figure 11A:
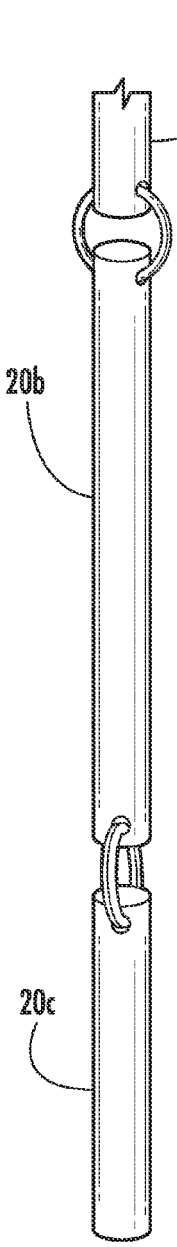
FIG. 11*a* is a partial front view of an alternative embodiment of a wand having three linked portions of the cordless roll-up shade of the present invention.
Figure 11B:
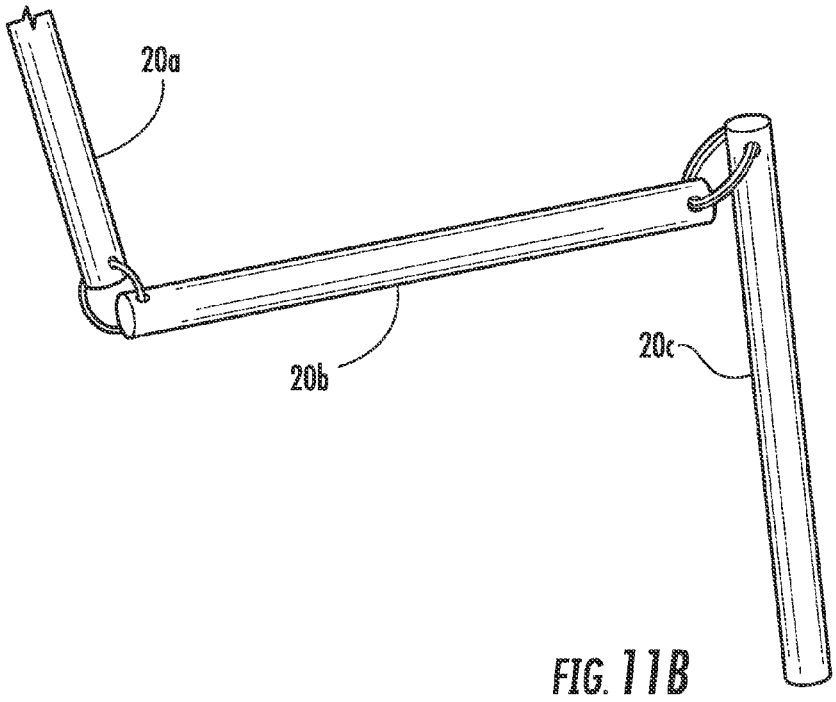
FIG. 11*b* is perspective view of an operator aligning the three linked portions of the alternative embodiment of the wand into a crank.
Figure 11C:
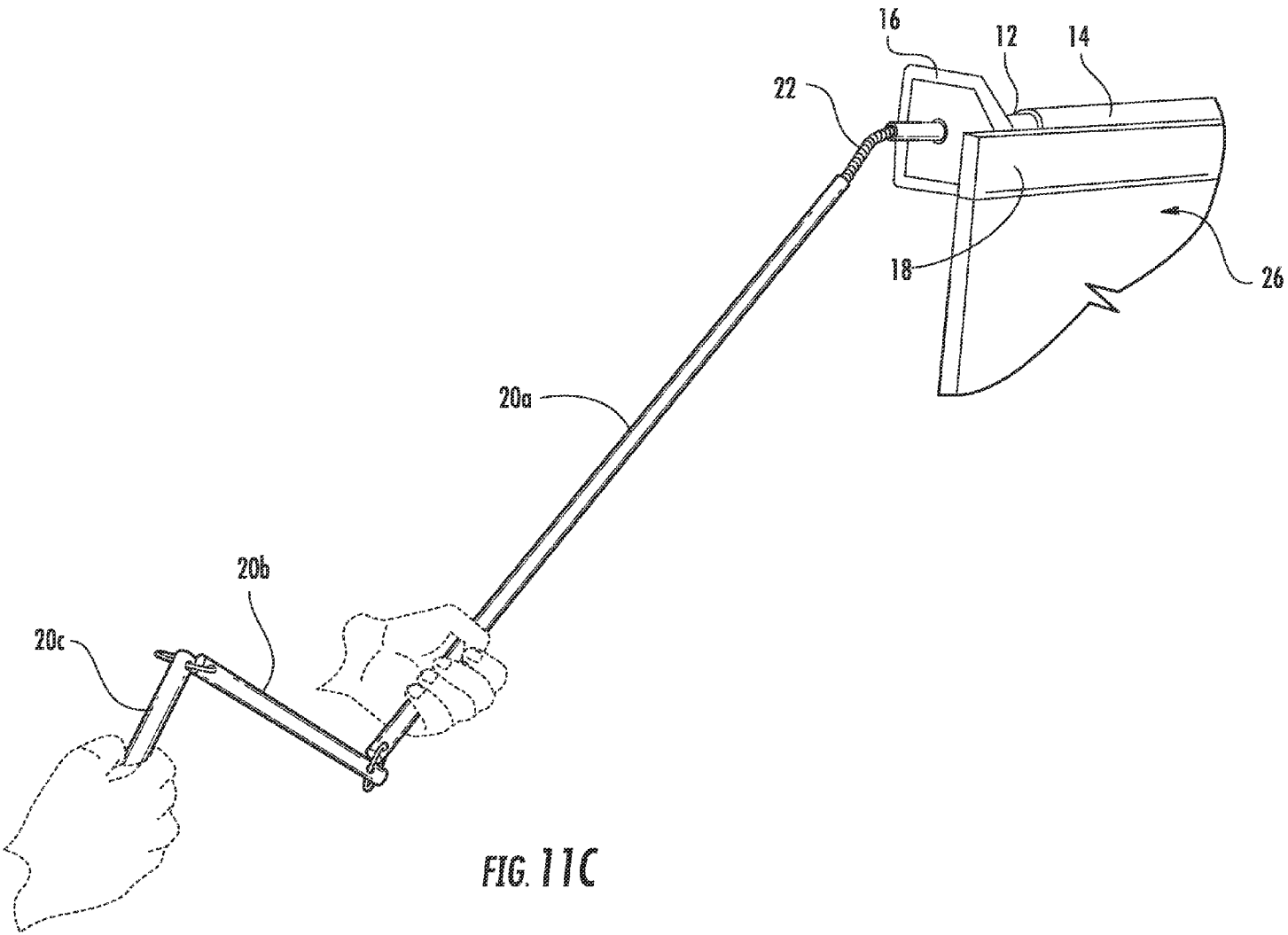
FIG. 11*c* is a perspective view of an operator using the three linked portions of the alternative embodiment of the wand as a crank.

Referring to FIGS. 11*a*-11*c*, the wand 20 may include three jointed sections 20*a*-20*c* that permit the operator to form a crank. The crank allows the operator to easily rotate the wand 20 to raise and lower the cordless roll-up shade 10. Optionally, a wand 20 with two jointed sections may also be used to form a crank (best seen in FIGS. 7 and 13*b*).

Figure 12A:
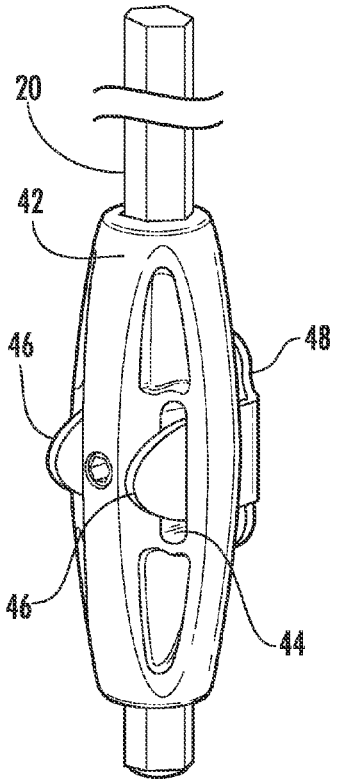
FIG. 12*a* is a close-up view of a first embodiment of the wand engaged on an anti-rotation cleat.
Figure 12B:
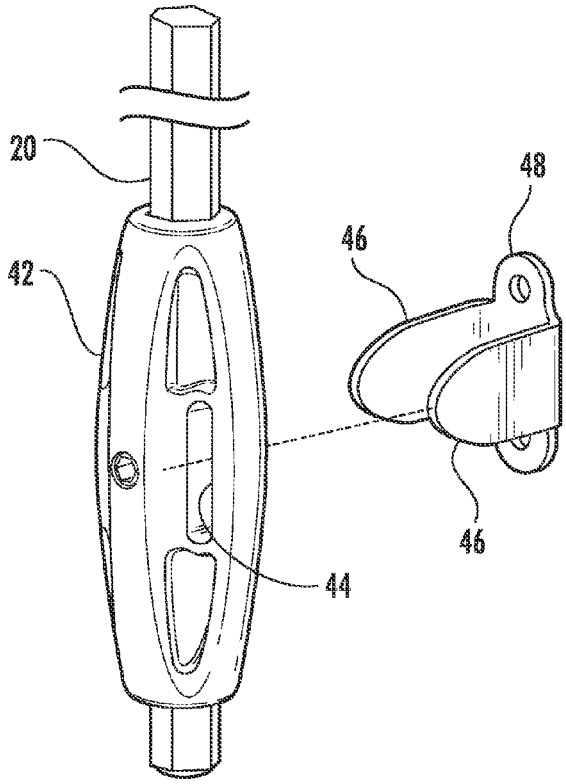
FIG. 12*b* is a close-up view of a first embodiment of the wand disengaged from the anti-rotation cleat.

Referring now to FIGS. 12*a* and 12*b*, the wand 20 may further include a grip 42 connected to the wand 20. The wand 20 is configured to attach to a window treatment adjustment mechanism, such as the transmissions illustrated in FIGS. 10*a*-10*d*, in order to raise or lower the window treatment or, alternatively in another application, adjust the pitch of the window treatment (e.g. mini-blinds). Rotating the wand 20 engages the window treatment adjustment mechanism.

The grip 42 includes at least one engagement surface 44, such as an aperture through the grip 42 that is configured to releasably couple to a reciprocal mating surface, such as a prong 46, of a cleat 48. The cleat 48 is further configured and arranged to be fixedly secured to a surface, such as a wall or window opening, to prevent the cleat 48 from moving. Preferably the cleat 48 includes two prongs 46, but may have a single prong 46 or a number of prongs 46 to engage the grip 42. The grip 42 is preferably configured to include the same number of engagement surfaces 44 as prongs 46 on the cleat 48, but more (or fewer) engagement surfaces 44 may be provided.

Figure 13A:
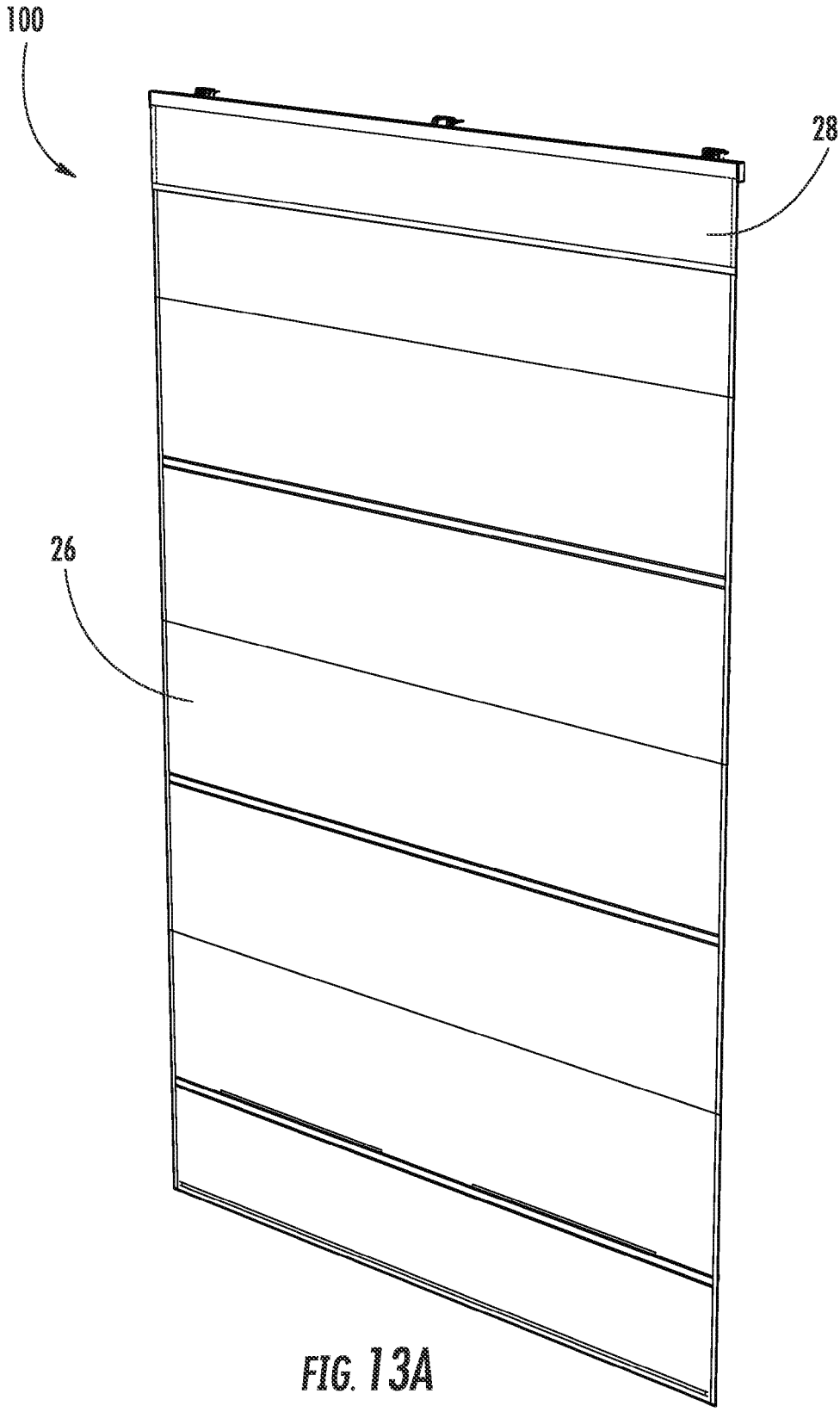
FIG. 13*a* is a front perspective view of an alternative embodiment of the cordless roll-up shade of the present configured for larger window openings.
Figure 13B:
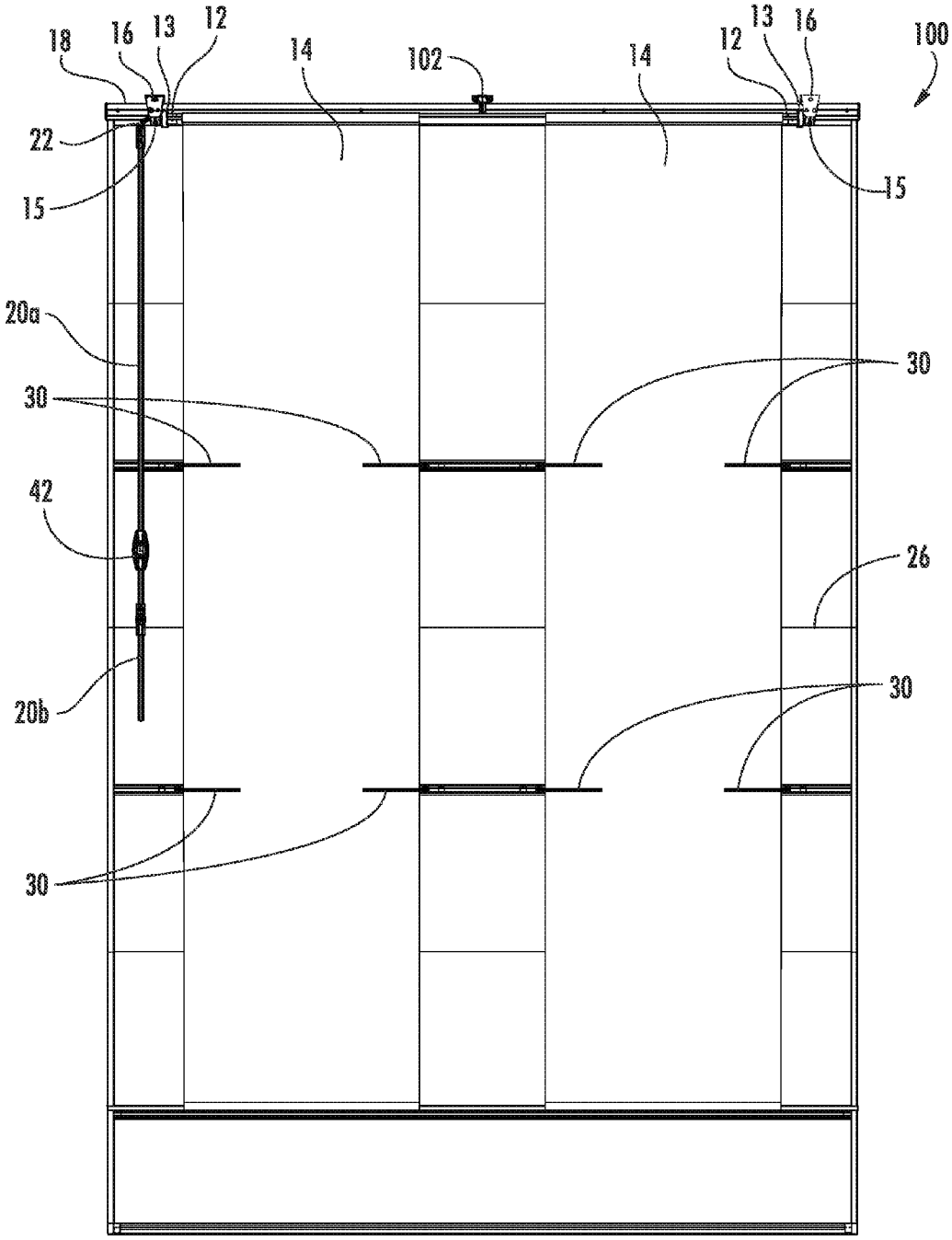
FIG. 13*b* is a rear view of an alternative embodiment of the cordless roll-up shade of the present invention showing the use of multiple roll-up shades.

Referring now to FIGS. 13*a* and 13*b*, an alternative embodiment of the cordless roll-up shade of the present invention is shown generally at 100. The alternative embodiment 100 includes multiple back panels 14, or lifting members, to raise and lower the front panel 26. The alternative embodiment 100 may include additional support assembly components such as a center support member 102, configured and arranged to further support the shade rod 12 and/or head rail 18. Optionally, the alternative embodiment 100 may include additional support assembly components, such as bearing blocks 13 and brackets 16, and multiple shade rods 12 and tube end connectors 15 as well to support additional bank panels 14. As can be seen the alternative embodiment is useful for covering wide window openings. As described previously, the width of the roll-up shades 14 may be selected to be sufficiently wide to avoid known strangulation hazards.

Therefore, it can be seen that the present invention provides a unique solution to the problem of providing a window treatment that does not use cords to raise and lower the window treatment, such as a Roman shade. Specifically, the cordless roll-up shade of the present invention uniquely includes a take up member, such as a shade rod, configured to gather a back panel, which raises or lowers a front panel. Also, the cordless roll-up shade of the present invention uniquely provides for a transmission or linkage for converting rotational movement on a wand into rotational movement on a take up member, such as a shade rod, to raise and lower and window treatment.

Furthermore, it can be seen that the present invention provides a unique solution to the problem of providing a method of mounting a window treatment in a window opening that permits the window treatment to overlap the sides of the window opening like an outside mount, yet is nearly flush with the window opening like an inside mount. The unique support assembly and head rail configuration of the hybrid mount of the present invention permit a window treatment that is wider than the window to be mounted nearly flush with the window opening, mount on the inside portion of the window opening, and includes a head rail that is wider than the window, yet still permits a nearly flush mount of a window treatment to the head rail and window opening.

Also, it can be seen that the present invention provides a unique solution to the problem of providing a handle with an anti-rotation mechanism suitable for adjusting a window treatment by providing a wand with a grip that engages prongs on a cleat.

It would be appreciated by those skilled in the art that various changes and modifications can be made to the illustrated embodiments without departing from the spirit of the present invention. All such modifications and changes are intended to be within the scope of the present invention except insofar as limited by the appended claims.

What is claimed is:

1. A handle assembly for adjusting the elevation of a window treatment which is part of a window shade assembly having a rotatable rod, the rotation of which rod causes raising or lowering of the window treatment, comprising:

a wand, connected directly or indirectly to said rod so the rod can thereby be rotated;

a grip, having at least one engagement feature, connected to the wand so the wand can be thereby rotated; and a cleat, attached to a surface, having at least one mating feature shaped to mate with the at least one engagement feature of the grip and thereby prevent rotation of said grip and said rod.

2. The assembly of claim 1, wherein said at least one engagement feature of the grip comprises at least one aperture in the grip.

3. The assembly of claim 1, wherein said at least one mating feature of the cleat comprises at least one prong.

4. The assembly of claim 3, wherein said at least one engagement feature of the grip comprises at least one aperture in the grip; and wherein the at least one prong inserts into the at least one aperture on the grip.

5. The assembly of claim 1, wherein said wand is comprised of two or more jointed sections.

6. The assembly of claim 1, wherein the grip has a multiplicity of said engagement features and the cleat has a multiplicity of said mating features.

7. The assembly of claim 1 wherein the window shade assembly comprises a cordless roll-up shade.

8. The assembly of claim 1 further comprising a geared transmission directly or indirectly interconnecting an end of the wand to said rod.

9. The assembly of claim 1 further comprising a flexible shaft interconnecting an end of the wand to said rod.

10. The assembly of claim 1 further comprising a universal joint interconnecting an end of the wand directly or indirectly to said rod.

11. The assembly of claim 1 wherein the wand has a length axis; wherein the grip has a length axis corresponding in orientation to the length of the wand; wherein the engagement feature of the grip is shaped to engage one or more prongs; wherein said cleat mating feature comprises one or more prongs, each prong shaped to mate with said grip engagement feature in a way which prevents rotation of the grip about its length axis.

12. A method of adjusting the elevation of a Roman shade window treatment which is part of a window shade assembly that is attached to the top part of the periphery of a window opening, the periphery having a top, a bottom, and opposing sides; wherein the window shade assembly has a rotatable rod which effects raising or lowering of the window treatment; and wherein the window treatment hangs within the periphery of said opening and has a lower end;

which comprises:

attaching a first end of a lifting panel to the rotatable rod so that the lifting panel is furled and unfurled from the rod by rotation thereof;

attaching a second end of the lifting panel to the window treatment in proximity to the lower end thereof, connecting a wand indirectly to the rod so the rod can thereby be rotated;

connecting a grip to the wand so the wand can thereby be rotated;

fastening a cleat to a side of said window opening periphery, wherein the cleat has features shaped to engage the grip in a way which prevents rotation thereof;

manually rotating the grip and thereby said wand and said interconnected rod, to furl or unfurl the lifting panel from the rod and thereby change the elevation of said attached bottom end of the window treatment; and, engaging the grip with the cleat, to thereby prevent further change in elevation of the lower end, when said window treatment bottom end reaches a particular elevation.

* * * * *